US010465531B2

(12) United States Patent
Puram et al.

(10) Patent No.: US 10,465,531 B2
(45) Date of Patent: Nov. 5, 2019

(54) TURBINE BLADE TIP SHROUD AND MID-SPAN SNUBBER WITH COMPOUND CONTACT ANGLE

(71) Applicant: General Electric Company, Schenectady, NY (US)

(72) Inventors: Gayathri Puram, Karnataka (IN); Sheo Narain Giri, Karnataka (IN); Harish Bommanakatte, Karnataka (IN)

(73) Assignee: General Electric Company, Schenectady, NY (US)

( * ) Notice: Subject to any disclaimer, the term of this patent is extended or adjusted under 35 U.S.C. 154(b) by 580 days.

(21) Appl. No.: 13/772,777

(22) Filed: Feb. 21, 2013

(65) Prior Publication Data

US 2014/0234110 A1 Aug. 21, 2014

(51) Int. Cl.
*F01D 5/22* (2006.01)

(52) U.S. Cl.
CPC ..... *F01D 5/225* (2013.01)

(58) Field of Classification Search
CPC ... F01D 5/22; F01D 5/225; F01D 5/24; F01D 5/066; F01D 25/06; F01D 2260/96
See application file for complete search history.

(56) References Cited

U.S. PATENT DOCUMENTS 2,772,854 A * 12/1956 Anxionnaz ..... 416/190
3,719,432 A 3/1973 Musick et al.
3,936,230 A 2/1976 Helmintoller, Jr. et al.
3,990,813 A 11/1976 Imai et al.
3,996,668 A 12/1976 Sharon
4,076,455 A 2/1978 Stargardter
4,083,655 A 4/1978 Tempere
4,108,573 A 8/1978 Wagner
4,257,741 A 3/1981 Betts et al.
4,257,743 A 3/1981 Fuji
4,326,836 A * 4/1982 Fitton ..... 416/196 R
4,643,645 A 2/1987 Robbins et al.
4,662,824 A 5/1987 Ortolano
(Continued)

FOREIGN PATENT DOCUMENTS

JP 11-229805 8/1999
JP 11229805 A * 8/1999
(Continued)

OTHER PUBLICATIONS

JP 11229805_MT, English Translation of JP 11229805.*
(Continued)

*Primary Examiner* — Bryan M Lettman
*Assistant Examiner* — Charles W Nichols
(74) *Attorney, Agent, or Firm* — Nixon & Vanderhye P.C.

(57) ABSTRACT

A turbine bucket adapted to be supported on a turbine or rotor wheel includes an airfoil portion extending radially relative to a longitudinal axis of the rotor wheel and having a leading edge, a trailing edge, a pressure side and a suction side. At least one tip shroud extends in opposite circumferential directions, the shroud having a first hard face adapted to engage a mating second hard face on a shroud extending circumferentially from an adjacent bucket. The first hard face defined by a surface portion that varies circumferentially with an increasing radius as measured from the longitudinal axis of the rotor wheel.

21 Claims, 6 Drawing Sheets

(56) References Cited

U.S. PATENT DOCUMENTS

| | | | | |
|---|---|---|---|---|
| 4,722,668 | A | 2/1988 | Novacek | |
| 4,734,010 | A | 3/1988 | Battig | |
| 4,798,519 | A | 1/1989 | Zipps et al. | |
| 4,919,593 | A | 4/1990 | Brown | |
| 5,056,738 | A | 10/1991 | Mercer et al. | |
| 5,257,908 | A | 11/1993 | Ortolano | |
| 5,275,531 | A | 1/1994 | Roberts | |
| 5,393,200 | A | 2/1995 | Dinh et al. | |
| 5,460,488 | A | 10/1995 | Spear et al. | |
| 5,511,948 | A * | 4/1996 | Suzuki et al. | 416/191 |
| 5,522,705 | A | 6/1996 | Elaini et al. | |
| 5,540,551 | A | 7/1996 | Heinig | |
| 5,562,419 | A | 10/1996 | Crall et al. | |
| 5,695,323 | A | 12/1997 | Pfeifer et al. | |
| 6,152,694 | A | 11/2000 | Ai | |
| 6,164,916 | A * | 12/2000 | Frost et al. | 416/189 |
| 6,299,410 | B1 | 10/2001 | Hilbert et al. | |
| 6,402,474 | B1 | 6/2002 | Okuno | |
| 6,503,053 | B2 | 1/2003 | Huebner | |
| 6,568,908 | B2 | 5/2003 | Namura et al. | |
| 6,779,979 | B1 | 8/2004 | Aspi et al. | |
| 6,814,543 | B2 | 11/2004 | Barb et al. | |
| 6,905,309 | B2 | 6/2005 | Nussbaum et al. | |
| 7,001,152 | B2 | 2/2006 | Paquet et al. | |
| 7,140,841 | B2 | 11/2006 | Goetzfried et al. | |
| 7,628,587 | B2 | 12/2009 | McFeat et al. | |
| 7,644,498 | B2 * | 1/2010 | Haehnle et al. | 29/889.1 |
| 2004/0258529 | A1 | 12/2004 | Crain et al. | |
| 2008/0145207 | A1 * | 6/2008 | Mohr | F01D 5/225 415/173.1 |
| 2012/0230826 | A1 * | 9/2012 | Raible | 416/196 R |

FOREIGN PATENT DOCUMENTS

| | | |
|---|---|---|
| JP | 2002-089203 | 3/2002 |
| JP | 2002-349204 | 12/2002 |
| JP | 2006-009733 | 1/2006 |
| JP | 2013-505385 | 2/2013 |

OTHER PUBLICATIONS

Japanese Office Action for Japanese Application No. 2014-030451 with partial English translation, five pages, dated Dec. 26, 2017.

* cited by examiner

TURBINE BLADE TIP SHROUD AND MID-SPAN SNUBBER WITH COMPOUND CONTACT ANGLE

BACKGROUND OF THE INVENTION

The invention relates generally to turbomachinery and, more specifically, to circumferential support arrangements for the airfoil portions of a row of blades or buckets mounted on a turbine rotor wheel.

Turbine blades or buckets are oftentimes supported at two locations along the radial length of the airfoil portion of the blades or buckets. Specifically, the radially-outer tips of the blades or buckets are engaged by individual tip shrouds while at locations intermediate the radially-inner and outer end of the airfoil portions, part-span or mid-span shrouds (sometimes referred to as mid-span snubbers) may be provided which engage similar mid-span shrouds on adjacent buckets.

Turbine bucket tip shrouds have a feature called a "hard face" which is the contact surface on each shroud that engages a similar contact surface or hard face on an adjacent shroud. The current tip shroud hard face design is a flat face which is oriented straight in a radial direction (see FIGS. 1 and 2). The tip shrouds support the buckets during turbine operation, holding them in proper alignment and resisting excessive movement due to the twisting forces exerted on the rotating buckets, while also acting as dampers of unwanted bucket vibrations. Some tip shrouds have well known Z-notch configurations where the hard faces or contact surfaces extend along adjacent multi-angled edges that often prove to be life-limiting locations for the buckets because they are subject to high stresses due to the bending of tip shroud overhangs and the load transfer between adjacent buckets. Shingling is another key problem with turbine bucket tip shrouds, caused by unequal displacement of pressure side and suction side overhangs of the tip shrouds.

Similarly, the mating hard faces or contact surfaces between adjacent mid-span shrouds or snubbers are also flat and oriented straight in a radial direction. Mid-span shrouds are particularly vulnerable to shingling and excessive vibrations, which also can be life-limiting.

It would therefore be desirable to provide a blade-to-blade interface at both tip shroud and mid-span shroud locations that reduce or eliminate the problems mentioned above with respect to stress, shingling and vibration.

BRIEF DESCRIPTION OF THE INVENTION

In one exemplary but nonlimiting embodiment, a turbine bucket adapted to be supported on a turbine or rotor wheel comprises an airfoil portion extending radially relative to a longitudinal axis of the rotor wheel and having a leading edge, a trailing edge, a pressure side and a suction side; at least one shroud extending in opposite circumferential directions, the shroud having a first hard face adapted to engage a mating second hard face on a shroud extending circumferentially from an adjacent bucket; the first hard face defined by a surface portion whose circumferential position varies with increasing radius from the longitudinal axis.

In another exemplary aspect, there is provided a turbine rotor wheel mounting a plurality of buckets, each bucket having an airfoil portion, the airfoil portion having a leading edge, a trailing edge, a pressure side and a suction side; adjacent buckets of the plurality of buckets engageable along contact surfaces provided on tip or mid-span shrouds fixed the airfoil portions, the contact surfaces being inclined in two angular respects to thereby enable relative movement along the contact surfaces.

In still another aspect, there is provided a turbine rotor wheel mounting a plurality of buckets, each bucket having an airfoil portion, the airfoil portion having a leading edge, a trailing edge, a pressure side and a suction side; adjacent buckets engageable along a first pair of contact surfaces provided on tip shrouds fixed to outer ends of the airfoil portions of the adjacent buckets, and a second pair of contact surfaces provided on mid-span shrouds fixed to pressure and suction sides, respectively, of the airfoil portions of the adjacent buckets, at least one of the pair of contact surfaces on the tip shrouds or the mid-span shrouds being inclined in two directions to thereby provide at least two degrees of freedom of movement for engaged adjacent buckets at the interface between the at least one pair of contact surfaces.

These and other aspects, advantages and salient features of the invention will become apparent from the following detailed description, in conjunction with the drawings identified below.

DETAILED DESCRIPTION OF THE INVENTION

Figure 1:
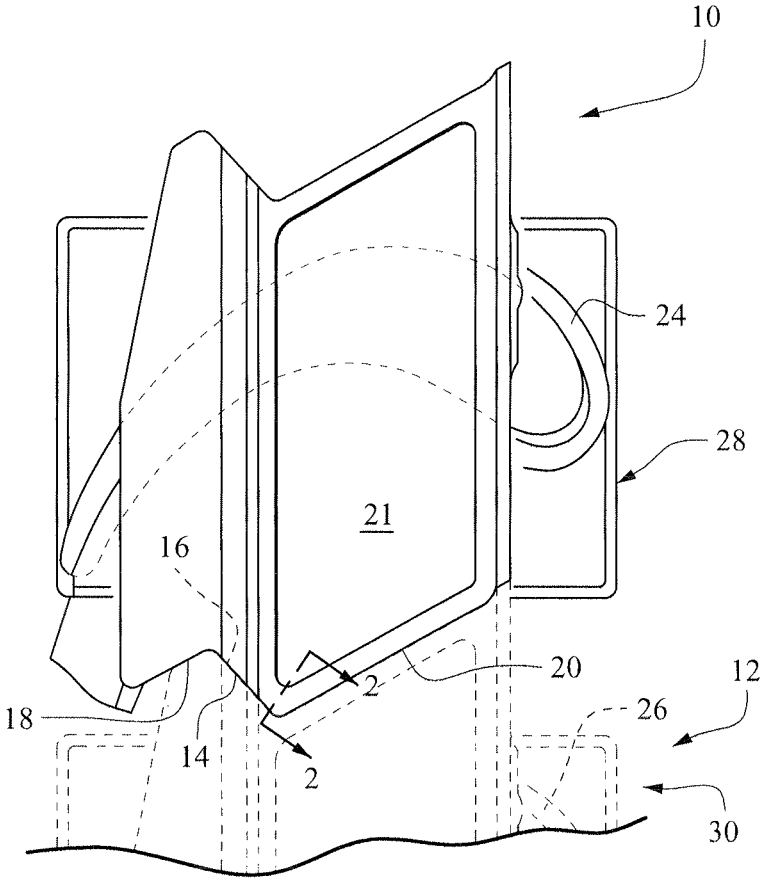
FIG. 1 (Prior Art)
FIG. 1 is a top plan view of a known Z-notch turbine bucket tip shroud, showing the mated engagement with an adjacent tip shroud, shown in phantom.

FIG. 1 provides one example of a conventional turbine bucket tip-shroud configuration. In this example, adjacent bucket tip shrouds 10, 12 are attached to the radially outer ends of respective airfoil portions of adjacent buckets. The tip shrouds 10, 12 have hard faces or contact surfaces 14, 16, respectively, that engage during turbine operation. With respect to shroud 10 shown in solid lines, contact surface or hard face 14 is located between edge portions 18 and 20 that together form a generally Z-shape. Tip shrouds of this general configuration are often referred to as "Z-Notch"

shrouds. The contact surfaces 14 and 16 lie in a radial plane that is substantially perpendicular to the radially-outer surfaces 21, 23 of the respective tip shrouds. Stated otherwise, the hard faces or contact surfaces 14, 16 are substantially perpendicular to a tangent on the radially-outer periphery of the circumferential row of buckets (airfoil portions 24, 26 of buckets 28, 30 affixed to a rotor wheel (not shown) are partially visible in FIG. 1) drawn to intersect the radial center line of the bucket at a 90° angle. Examples of contact surface configurations as described can be found in U.S. Pat. Nos. 5,522,705; 6,402,474; and 7,001,152.

While not separately shown, it will be understood that typical mid-span shrouds or snubbers have similar contact surfaces that lie in a radial plane perpendicular to a tangent to the periphery of the row of buckets mounted on the rotor wheel.

It has now been determined that there are benefits associated with a modification to the traditional radially-oriented hard faces or contact surface portions of adjacent bucket tip shrouds. Specifically, it has been determined that having the hard faces or contact surfaces inclined in the radial direction, improves tip shroud capability in terms of reduction in Z-notch stresses and/or shingling.

A similar hard face or contact surface configuration in mid-span snubbers or part-span shrouds has been shown to reduce bucket vibration at the mid-span location. Both tip shrouds and mid-span shrouds in accordance with exemplary but non-limiting embodiments are described separately below.

Tip Shrouds

In accordance with an exemplary but nonlimiting embodiment of the invention, the hard faces or contact surfaces on adjacent buckets remain substantially parallel but are inclined in the radial direction. The angle of inclination and the direction of inclination depend on design requirements including the shape of the tip shrouds and the particular problem to be addressed, e.g., Z-notch stress, shingling, damping effectiveness or frequency tuning.

Figure 3:
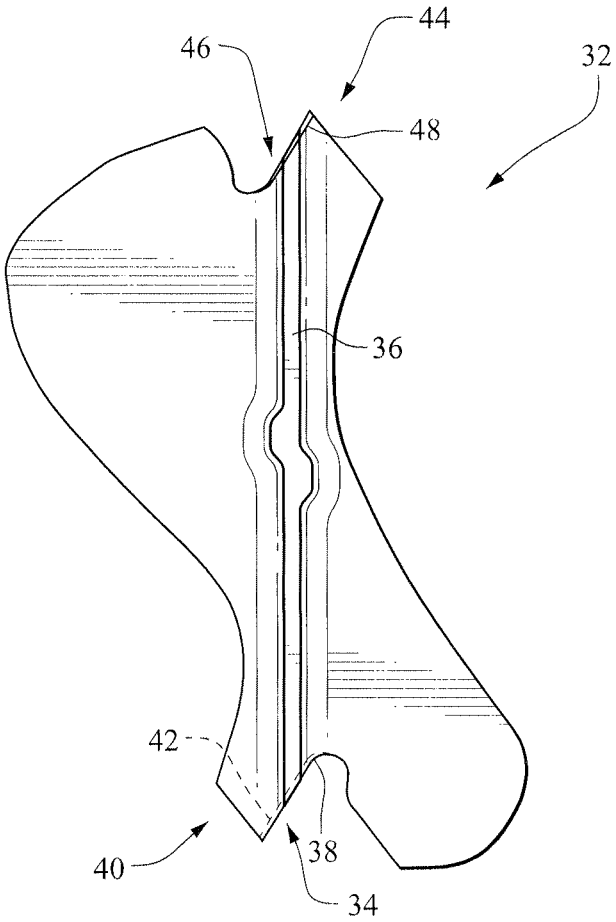
FIG. 3 is a plan view of a bucket tip shroud in accordance with a first exemplary but nonlimiting embodiment of the invention.

Specifically, and with reference initially to FIG. 3, the bucket tip shroud 32 has a Z-notch configuration at opposite sides of the shroud that are adapted to at least partially engage similar shrouds on adjacent buckets. As described below, the hard face or contact surface portion 34 of the shroud 32 is shown to include an edge on either side of a radially-projecting rib 36, and extending into a generally U-shaped curve 38, but it will be understood that the contact surface portion may extend further in either direction from the rib 36, depending on specific applications. At the end 40 of the shroud 32, the contact surface portion 34 is undercut in a radial direction as indicated by the dotted line 42. In other words, the contact surface is slanted at a negative angle relative to the upper edge of the shroud in a radially inward direction, so that the contact surface portion 34 is no longer perpendicular to a tangent to the rotor wheel. At the opposite end 44 of the tip shroud 32, the contact surface portion 46 is oppositely slanted in the radially inward direction as indicated by the solid line 48. It will be appreciated that in a circumferential row of similar buckets with similar tip shrouds, the end 40 of shroud 32 will engage an end like end 44 of an adjacent tip shroud. Thus, the contact surface portions will remain substantially parallel to each other but will lie at an angle to a radial plane extending from the axis of the rotor wheel. In practical terms, it may be said that a wedge of contact surface material is "removed" from the hard face of one shroud end to establish a negative inclination angle and "added" to an adjacent hard face to establish a positive inclination angle, thus allowing the adjacent hard faces to remain substantially parallel but along a radially-inclined plane. It is also possible to describe the contact surface portion of each tip shroud in terms of a circumferential position along the hard face or contact surface that varies with an increasing radius as measured from the center or longitudinal axis of the rotor wheel.

By inclining the hard faces or contact surface portions, both radial and circumferential components of sliding motion are permitted at the interface of the tip shrouds. This is unlike the prior hard face or contact surface configurations wherein, at the interface, relative motion is possible only in a radial direction. Thus, the invention here provides an additional degree of freedom of movement at the interface between adjacent tip shrouds.

As indicated above, the angle of inclination of the contact surfaces may vary in both positive and negative directions. The inclination angle and the determination as to whether the positive or negative inclination angle is on the shroud portion extending away from the pressure or suction side of the bucket may vary with specific applications. Angles of between 2° and about 15° and preferably 5° and 10° in either a negative or positive direction, should improve tip shroud performance in terms of decreasing Z-notch stresses and shingling, while also enabling enhanced frequency tuning via adjustment of the inclination angles. With regard to shingling, the tip shroud hard faces can be inclined so that the overhang with higher radial displacement can be made to sit on the lower side, so that during operation, the least displaced overhung side will arrest the other side overhang displacement, thereby maintaining hard face contact throughout the operation.

Figure 2:
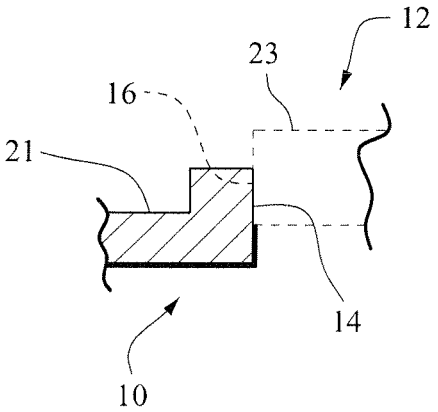
FIG. 2 (Prior Art)
FIG. 2 is a section view taken along the line 2-2 in FIG. 1.
Figure 4:
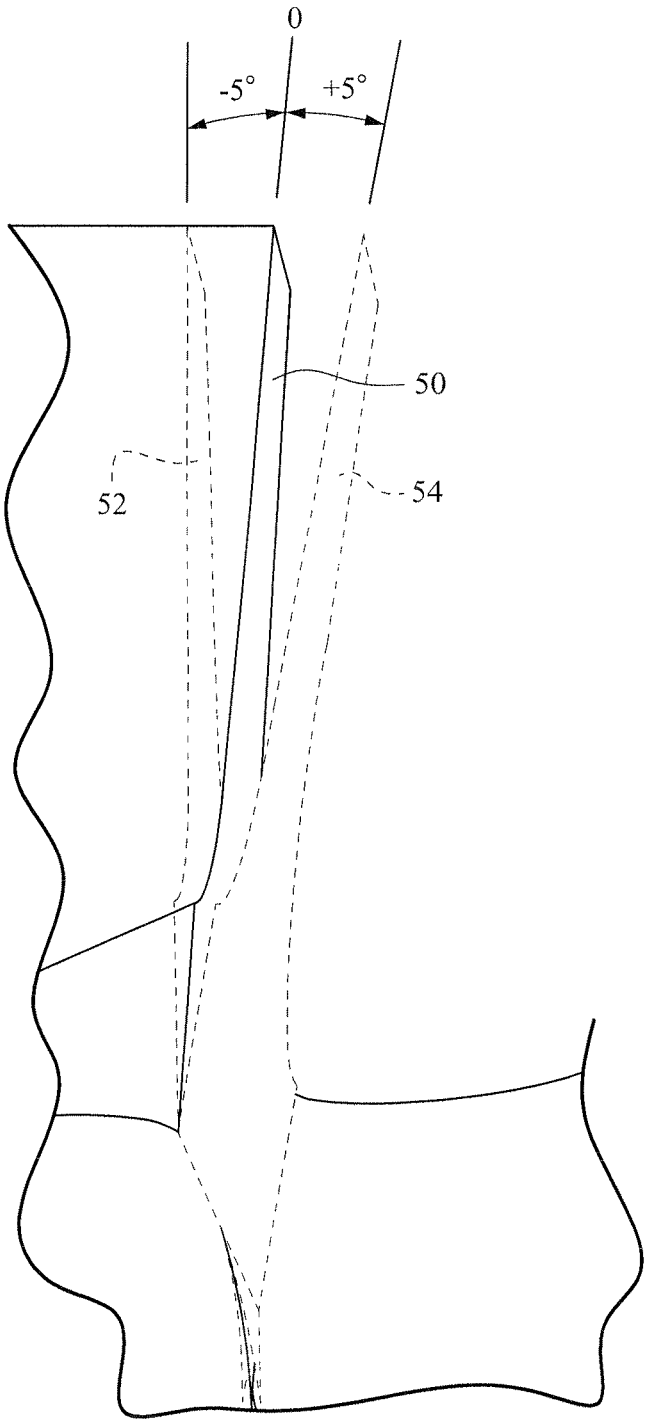
FIG. 4 is a perspective view of a contact surface portion of a tip shroud illustrating positive and negative angles of inclination in accordance with the invention.

A representation of negative and positive angles of inclination for the hard faces or contact surfaces is shown in FIG. 4. Specifically, the hard face or contact surface 50 shown in solid lines represents the current practice substantially as represented in FIG. 2. In accordance with one exemplary but nonlimiting embodiments of this invention, the hard faces or contact surfaces are inclined at a −5° inclination angle or a +5° inclination angle, relative to a radial reference plane.

Figure 5:
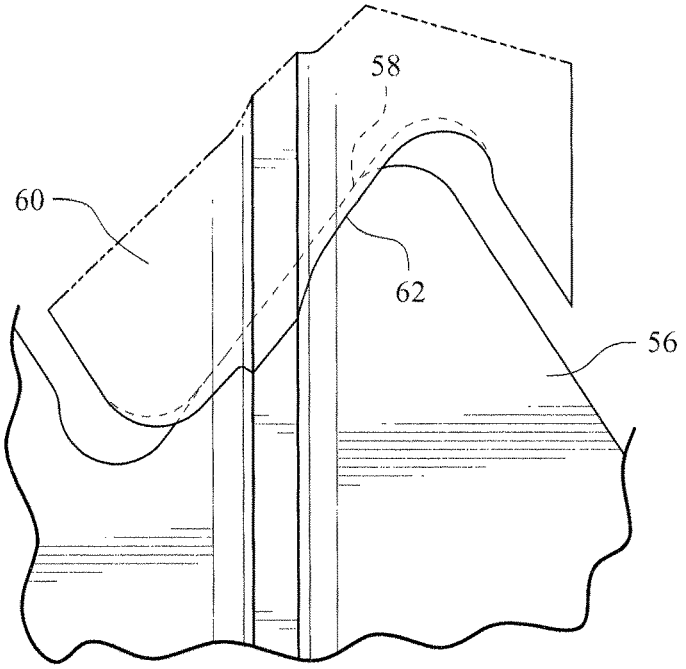
FIG. 5 is a detail in plan of mated contact surfaces of adjacent tip shrouds with a negative angle of inclination in accordance with the invention.

FIG. 5 illustrates an exemplary implementation. Thus, the tip shroud 56 is formed at one with a hard face or contact surface 58 at a positive inclination angle, mating with an adjacent tip shroud 60 formed with a hard face or contact surface 62 at a complimentary negative inclination angle.

Figure 6:
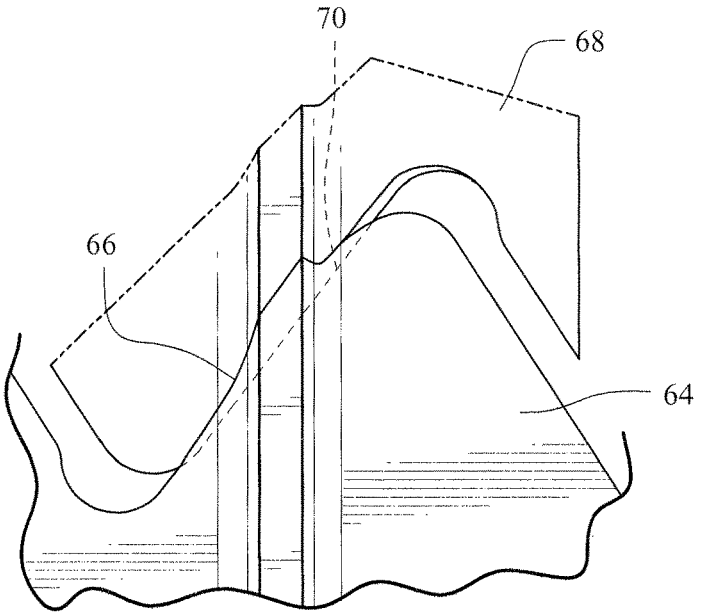
FIG. 6 is a detail in plan of mated contact surfaces of adjacent tip shrouds with a positive angle of inclination in accordance with the invention.

FIG. 6 illustrates an opposite or reverse configuration where the tip shroud 64 is formed with a hard face or contact surface 66 at a negative inclination angle and adjacent shroud 68 is formed with a hard face or contact surface 70 at a positive inclination angle.

It should be understood that the inclination of the contact surfaces as described above is equally applicable to other shroud configurations, i.e. those that employ straight edges or angled edges other than z-notch edges. In other words, the contact surfaces could be straight along the entire line of contact and be axially aligned with the rotor axis or at one or more angle relative to that axis. Straight-line contact surfaces are brought into sharper focus in the description of the mid-span shrouds below.

In all cases, the angle of inclination and the direction of inclination can be defined in order to meet design requirements.

Mid-Span Shroud or Snubber

Figure 7:
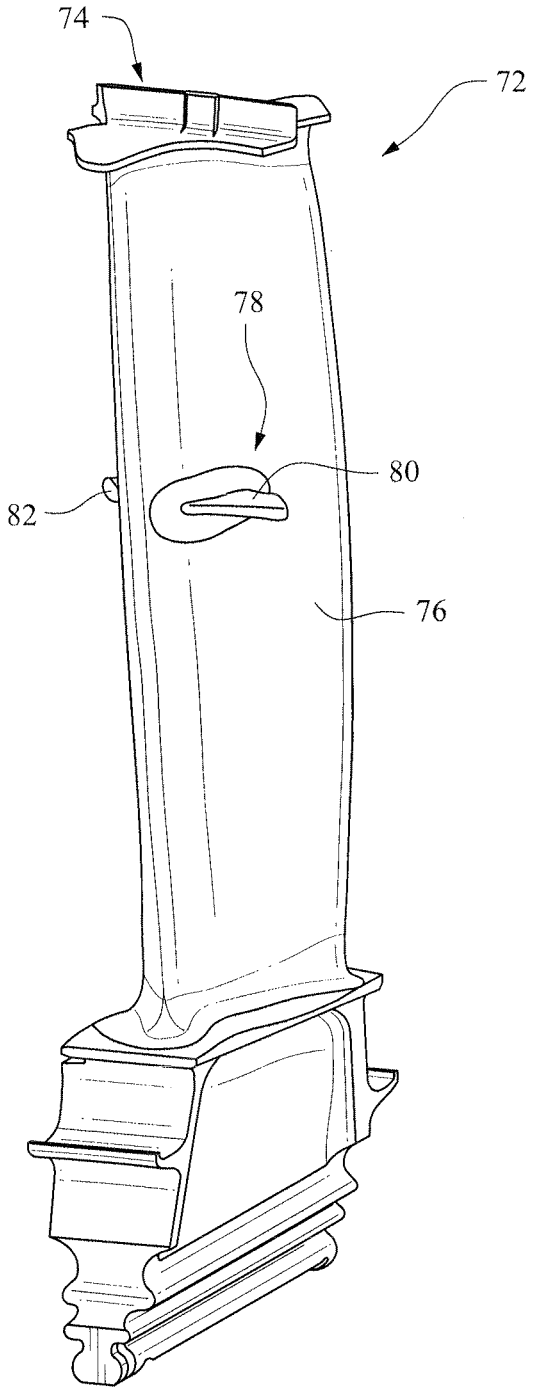
FIG. 7 is a perspective view of a turbine bucket fitted with mid-span shrouds or snubbers in accordance with another exemplary but nonlimiting embodiment of the invention.
Figure 8:
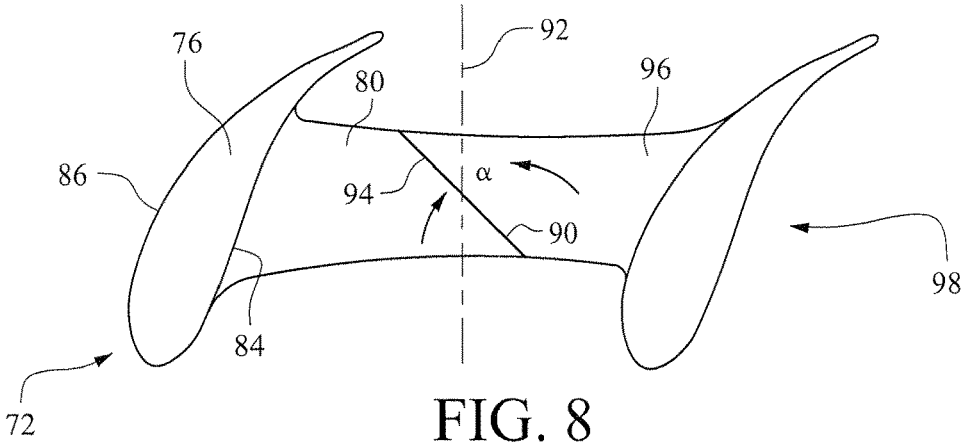
FIG. 8 is a partial plan view of the adjacent mid-span shrouds shown in FIG. 7, but also showing respective airfoil portions of adjacent buckets.

Turning to FIG. 7, a bucket 72 is shown with a tip shroud 74 at the radially outer end of the airfoil portion 76 of the bucket, and a mid-span shroud 78 located between the radially inner and outer ends of the airfoil portion. Since the mid-span shroud 78 in fact comprises two discrete shrouds 80, 82 projecting from the pressure and suction sides, 84, 86 respectively (see FIG. 8), of the airfoil portion, it may be appropriate to refer to mid-span shroud portions 80, 82 on each bucket airfoil. It has been determined that a compound-angle contact surface arrangement for mid-span shrouds or shroud portions also reduces vibration by providing an additional degree of freedom of movement at the contact surface interface substantially as described above.

Figure 9:
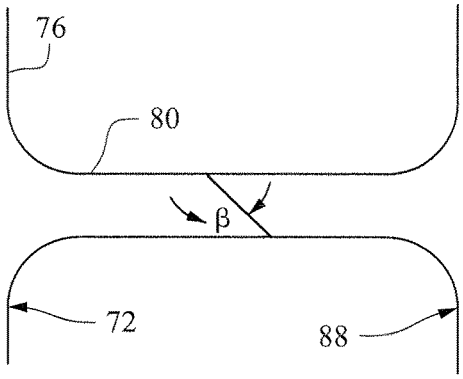
FIG. 9 is a partial side elevation view of the mid-span shrouds shown in FIG. 8.
Figure 10:
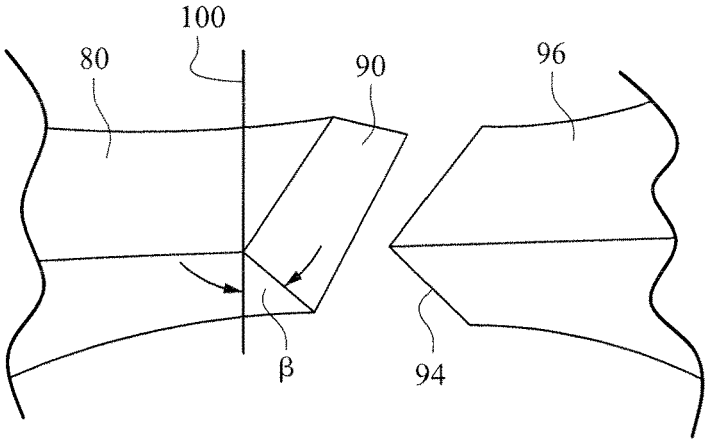
FIG. 10 is a partial perspective view of the adjacent mid-span shrouds shown in FIGS. 8 and 9, but separated to show the compound angles of the respective contact surfaces of the mid-span shrouds.

In an exemplary but nonlimiting embodiment relating to mid-span shrouds, the contact surface angle is inclined in two directions, i.e., in a radial direction and in an axial direction. Thus, with reference to FIG. 8, viewing the mid-span shroud interface between a pair of adjacent buckets 72, 98 in plan view, it can be seen that shroud portion projecting laterally from the pressure side 84 of the airfoil portion 76 is formed with a straight contact surface 90 forming an angle alpha relative to a longitudinal axis of the rotor, represented at 92. The hard face or contact surface 90 is shown engaged with a hard face or contact surface 94 on the shroud portion 96 of the adjacent bucket 98. This aspect of the contact surface configuration is not per se new. The contact surface interface, however, is also angled radially as shown in FIGS. 9 and 10, thus forming an angle beta relative to a radial plane indicated at 100 (FIG. 10). This radial inclination is similar to the radial inclination and the tip shroud contact surface interface described above. The angles $\alpha$ and ß can be tailored to optimize the damping behavior of the mid-span snubber or shroud, and may also be within a range of about 2 to about 15 degrees (or more) depending on specific applications.

For both tip and mid-span shrouds, the invention improves part life with few changes to the geometry of the shrouds. Thus, the chances of forced outages due to resonance or shingling are decreased.

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine bucket adapted to be supported on a turbine or rotor wheel comprising:

an airfoil portion extending radially relative to a longitudinal axis of the rotor wheel and having a leading edge, a trailing edge, a pressure side and a suction side; and at least one shroud extending in opposite circumferential directions, said shroud having a radially-projecting rib on an outside surface of the shroud and z-notch edges at each of two opposite sides thereof adapted to engage corresponding z-notch edges on shrouds extending circumferentially from adjacent buckets, each of the z-notch edges including a first hard face adapted to engage a mating second hard face on the shroud extending circumferentially from the adjacent bucket, said first hard face extending to a U-shaped curve of a respective said z-notch edge, each side of the z-notch edges being straight in a radial direction, and said first hard face defined by a planar surface portion being angled in a radial direction relative to a radial plane extending radially from the longitudinal axis of the rotor wheel and being angled in an axial direction relative to the longitudinal axis of the rotor wheel to thereby enable relative movement of adjacent shrouds along the planar surface portion in the axial and radial directions, the planar surface portion extending in opposite directions from the radially-projecting rib and including one end of the radially-projecting rib, and the planar surface portion is linear along the entire thickness of the shroud and the radially-projecting rib in a radial direction.

2. The turbine bucket according to claim 1 wherein said at least one shroud comprises a first tip shroud at a radially outer end of said bucket.

3. The turbine bucket according to claim 1 wherein said at least one shroud comprises a first mid-span shroud portion projecting from one side of said bucket, and a second mid-span shroud portion projecting from an opposite side of said bucket, said first and second mid-span shroud portions located radially between inner and outer ends of said airfoil portion of said bucket.

4. The turbine bucket according to claim 1, wherein said first hard face is provided in a middle portion of the z-notch edge, wherein the middle portion extends in opposite directions from and below the radially-projecting rib.

5. The turbine bucket according to claim 1 wherein said first hard face is oriented at a first acute angle in a range of from 2 to 15 degrees in either of two opposite directions relative to the plane extending radially from the longitudinal axis and along a center line of the bucket.

6. The turbine bucket according to claim 5 wherein said first acute angle is in a range 5 and 10 degrees.

7. A turbine rotor wheel mounting a plurality of buckets, each bucket having an airfoil portion, said airfoil portion having a leading edge, a trailing edge, a pressure side and a suction side;

adjacent buckets of said plurality of buckets engageable along contact surfaces provided on tip and mid-span shrouds fixed to said airfoil portions, said tip shroud adapted to engage a mating contact surface on another tip shroud extending circumferentially from an adjacent bucket, said tip shrouds including a radially-projecting rib on an outside surface of the shroud and the tip shroud contact surfaces including z-notch edges at each of two opposite sides of the tip shroud adapted to engage corresponding z-notch edges on tip shrouds extending circumferentially from adjacent buckets, and said mid-span shroud adapted to engage a mating contact surface on another mid-span shroud extending circumferentially from the adjacent bucket; and each side of the z-notch edges being straight in a radial direction and each z-notch edge including a planar hard face surface (1) being angled in a radial direction relative to a radial plane extending radially from the longitudinal axis of the rotor wheel and being angled in an axial direction relative to the longitudinal axis of the rotor wheel, (2) including an end of the radially-projecting rib, (3) extending in opposite directions from the radially-projecting rib, (4) being entirely linear in a radial direction along the entire thickness of the tip shroud and the radially-projecting rib to thereby enable relative movement between adjacent tip shrouds along said planar hard face surfaces in the axial and radial directions, and (5) extending to a U-shaped curve of a respective said z-notch edge.

8. The turbine rotor wheel of claim 7 wherein movement in one angular respect is enabled by having a circumferential position of said contact surfaces of said tip and mid-span shrouds vary with increasing radius, thereby creating a first angle of inclination.

9. The turbine rotor wheel of claim 8 wherein said contact surfaces of said tip and mid-span shrouds lie at a second angle of inclination relative to the longitudinal axis of the turbine rotor wheel when viewed in plan.

10. The turbine rotor wheel of claim 8 wherein said first angle of inclination may be positive or negative relative to a radial reference plane.

11. The turbine rotor wheel of claim 7 wherein said adjacent buckets are engageable at both tip and mid-span shrouds.

12. The turbine rotor wheel according to claim 8 wherein said first angle of inclination is in a range of from 2 to 15 degrees on either side of a radial reference plane extending along a center line of the bucket.

13. The turbine rotor wheel according to claim 12 wherein said first angle is in a range of from 5 to 10 degrees.

14. A turbine rotor wheel mounting a plurality of buckets, each bucket having an airfoil portion, said airfoil portion having a leading edge, a trailing edge, a pressure side and a suction side;

adjacent buckets engageable along a first pair of contact surfaces provided on z-notch edges of tip shrouds fixed to outer ends of said airfoil portions of said adjacent buckets, and a second pair of contact surfaces provided on mid-span shrouds fixed to pressure and suction sides, respectively, of said airfoil portions of said adjacent buckets;

said tip shrouds each comprising a radially-projecting rib on a surface of the respective tip shroud;

each side of the z-notch edges being straight in a radial direction and said first pair of contact surfaces on said tip shrouds being angled in a radial direction relative to a radial plane extending radially from the longitudinal axis of the rotor wheel and angled in an axial direction relative to the longitudinal axis of the rotor wheel to thereby provide at least two degrees of freedom of movement for engaged adjacent buckets at the interface between said first pair of contact surface, each contact surface of said first pair of contact surfaces on said tip shrouds includes a planar hard face surface extending in opposite directions from the radially-projecting rib provided on the surface of the respective tip shrouds and includes one end of the radially-projecting rib, said planar hard face surface of said first pair of contact surfaces being entirely straight along the entire thickness of the tip shrouds and the radially-projecting rib in a radial direction, and said planar hard face extending to a U-shaped curve of a respective said z-notch edge.

15. The turbine rotor wheel of claim 14 wherein said first and second pairs of contact surfaces vary circumferentially with an increasing radius as measured from a center axis of the rotor wheel.

16. The turbine rotor wheel of claim 14 wherein said first and second pairs of contact surfaces are inclined at an angle of from 2 to 15 degrees relative to a radial reference plane extending along a center line of the bucket.

17. The turbine rotor wheel of claim 14 wherein said contact surfaces of said tip shrouds and said mid-span shrouds are straight and are inclined at the same angle relative to a radial reference plane extending along a center line of the bucket.

18. The turbine rotor wheel of claim 14 wherein said first and second pairs of contact surfaces define a multi-angled edge.

19. A turbine bucket configured to be arranged in an annular row of turbine buckets each supported on a wheel in a turbine, the turbine bucket comprising:

an airfoil portion extending radially relative to a rotational axis of the wheel and having a leading edge, a trailing edge, a pressure side and a suction side, wherein the airfoil portion spans a hot gas path through the turbine;

a pressure side mid-span shroud extending from the pressure side of the airfoil portion along a tangent to the rotational axis, the pressure side mid-span shroud including a leading edge, a trailing edge shorter than the leading edge, and a first end face extending between the leading and trailing edges, wherein the first end face is configured to engage an end face of a mid-span shroud of an adjacent turbine bucket in the annular row, wherein the first end face has a hard face surface portion which varies linearly in both a radial direction and a tangential direction to thereby enable relative movement between adjacent mid-span shrouds of adjacent turbine buckets in the axial and radial directions;

a suction side mid-span shroud extending from the suction side of the airfoil portion along a tangent to the rotational axis, the suction side mid-span shroud including a leading edge, a trailing edge longer than the leading edge, and a second end face extending between the leading and trailing edges, wherein the second end face is configured to engage an end face of a mid-span shroud of an adjacent turbine bucket in the annular row, wherein the second end face has a hard face surface portion which varies linearly in both a radial direction and a tangential direction to thereby enable relative movement between adjacent mid-span shrouds of adjacent turbine buckets in the axial and radial directions; and a tip shroud provided at the radially outer end of the airfoil portion and extending in opposite circumferential directions towards the suction side of the airfoil portion and towards the pressure side of the airfoil portion, the tip shroud including a radially-projecting rib on an outside surface of the tip shroud and z-notch edges at each of two opposite sides thereof adapted to engage corresponding z-notch edges on adjacent bucket tip shrouds, each side of the z-notch edges being straight in a radial direction and each z-notch edge including a planar hard face configured to engage corresponding planar hard face of adjacent bucket tip shrouds, wherein the planar hard face of the tip shroud (1) has a hard face surface portion which varies linearly in both a radial direction and a tangential direction to thereby enable relative movement between adjacent tip shrouds of adjacent turbine buckets in the axial and radial directions, (2) extends in opposite directions from the radially-projecting rib, (3) includes an end of the radially-projecting rib, (4) is linear along the entire thickness of the tip shroud and the radially-projecting rib, and (5) extends to a U-shaped curve of a respective said z-notch edge.

20. The turbine bucket according to claim 19, wherein an edge of the U-shaped curve is straight in the radial direction.

21. The turbine bucket according to claim 19, wherein said planar hard face of the tip shroud extends in opposite directions from the radially-projecting rib to a first curve of said z-notch edge on one side of the radially-projecting rib and to a second curve of said z-notch edge on another side of the radially-projecting rib, wherein a portion of the first curve includes an edge that is straight in the radial direction, and a portion of the second curve includes an edge that is straight in the radial direction.

* * * * *